US007528312B1

(12) United States Patent
DiGiovanni

(10) Patent No.: US 7,528,312 B1
(45) Date of Patent: May 5, 2009

(54) DRUM FOR STRIKING UPWARDLY AND METHOD THEREFOR

(76) Inventor: Stephen DiGiovanni, 450 E. 83 St. (Apt. 11A), New York, NY (US) 10028

( * ) Notice: Subject to any disclaimer, the term of this patent is extended or adjusted under 35 U.S.C. 154(b) by 0 days.

(21) Appl. No.: 11/677,163

(22) Filed: Feb. 21, 2007

(51) Int. Cl.
*G10D 13/02* (2006.01)

(52) U.S. Cl. ..... 84/411 R; 84/421; 84/422.1; 84/422.2

(58) Field of Classification Search ..... 84/411 R, 84/102–104, 111, 422.1, 422.2, DIG. 12, 84/DIG. 21, 421
See application file for complete search history.

(56) References Cited

U.S. PATENT DOCUMENTS

| | | | | | |
|---|---|---|---|---|---|
| 273,414 | A | * | 3/1883 | Westphal | 446/421 |
| 423,060 | A | * | 3/1890 | Legault | 84/411 R |
| 471,046 | A | * | 3/1892 | Wilskey | 446/421 |
| 479,636 | A | * | 7/1892 | Droop | 84/422.1 |
| 640,114 | A | * | 12/1899 | Dowling | 74/96 |
| 770,300 | A | * | 9/1904 | Meinel | 84/104 |
| 783,888 | A | * | 2/1905 | Noble | 84/422.1 |
| 823,713 | A | | 6/1906 | Chein | |
| 932,213 | A | * | 8/1909 | Wieser | 84/104 |
| 938,899 | A | * | 11/1909 | Schipper | 84/422.2 |
| 976,718 | A | | 11/1910 | Bartholomae | |
| 1,055,688 | A | * | 3/1913 | Wood | 84/104 |
| 1,055,689 | A | * | 3/1913 | Wood | 84/422.1 |
| 1,243,645 | A | | 10/1917 | Van Valkenburg | |
| 1,387,188 | A | * | 8/1921 | Shann | 116/149 |
| 1,490,914 | A | * | 4/1924 | Cornell | 446/422 |
| 1,699,749 | A | * | 1/1929 | Obergfell | 340/392.1 |
| 1,808,085 | A | * | 6/1931 | Troppe | 84/422.1 |
| 2,216,956 | A | * | 10/1940 | Morton | 116/149 |
| 2,280,582 | A | | 4/1942 | Hoeflich | |
| 2,502,273 | A | * | 3/1950 | Patry et al. | 379/378 |
| 2,540,051 | A | * | 1/1951 | Ludwig | 84/422.1 |
| 2,548,271 | A | * | 4/1951 | Percy | 84/411 R |
| 2,800,101 | A | * | 7/1957 | Amann et al. | 116/149 |
| 2,858,724 | A | * | 11/1958 | Troppe | 84/411 R |
| 2,890,447 | A | * | 6/1959 | Willy et al. | 340/401.1 |
| D196,184 | S | | 9/1963 | Renzi | |
| 3,215,021 | A | * | 11/1965 | Kester, Jr. | 84/411 R |
| 3,439,572 | A | | 4/1969 | Cohen | |
| 3,677,128 | A | * | 7/1972 | Simpson | 84/422.1 |
| 3,967,523 | A | * | 7/1976 | Currier et al. | 84/422.1 |
| 4,204,400 | A | | 5/1980 | Morohoshi et al. | |
| D258,594 | S | * | 3/1981 | Wohlert | D17/99 |
| 4,300,437 | A | * | 11/1981 | Hinger et al. | 84/411 R |
| 4,566,400 | A | * | 1/1986 | Keenan et al. | 116/171 |

(Continued)

OTHER PUBLICATIONS

Up-Stroke Trainer, Drum-Gym Products, viewed Aug. 27, 2008 at www.drumtrainer.com.*

(Continued)

*Primary Examiner*—Jeffrey Donels
*Assistant Examiner*—Robert W Horn
(74) *Attorney, Agent, or Firm*—Davidoff Malito & Hutcher, LLP

(57) ABSTRACT

Two drums are arranged so that a head of each faces each other in close proximity to enable a distal end of a drum stick, hand or mallet that is positioned between them to strike both when moving the drum stick, hand or mallet first toward and against one and then toward and against the other.

24 Claims, 4 Drawing Sheets

U.S. PATENT DOCUMENTS

| | | | | | |
|---|---|---|---|---|---|
| D292,424 | S | * | 10/1987 | Jones | D21/406 |
| D312,844 | S | * | 12/1990 | Jones | D21/406 |
| 5,063,821 | A | | 11/1991 | Battle | |
| 5,076,131 | A | | 12/1991 | Patterson | |
| 5,315,909 | A | * | 5/1994 | Hsu | 84/404 |
| 5,467,680 | A | * | 11/1995 | Kurosaki | 84/421 |
| 5,550,319 | A | * | 8/1996 | Segan et al. | 84/103 |
| 5,813,899 | A | * | 9/1998 | Hartley | 446/422 |
| 6,979,770 | B2 | * | 12/2005 | Hampton, Jr. | 84/723 |
| 7,074,997 | B2 | * | 7/2006 | Steele | 84/422.1 |
| 7,339,103 | B2 | * | 3/2008 | Hilburn | 84/422.1 |
| 2004/0025664 | A1 | * | 2/2004 | Bennett | 84/411 P |
| 2004/0074372 | A1 | | 4/2004 | Studer | |
| 2005/0211058 | A1 | * | 9/2005 | Crane | 84/402 |

OTHER PUBLICATIONS

Fundamentals of Stroke, Articulation, and Tone, drum playing performance training from Capital University regarding developing drumming skills, viewed Sep. 5, 2008 at www.capital.edu/3761/.*

"Latin Percussion Aspire Timbale Set with High Pitch Jam Block" http://www.musiciansfriend.com/product/Latin-Percussion-Aspire-Timbale-Set-with-High-Pitch-Jam-block-?sku=44312.

"Latin Percussion LP209 Vibra-Slap II Deluxe" http://www.musiciansfriend.com/product/Latin-Percussion-LP209-Vibra-Slap-II-Deluxe?sku-440620.

* cited by examiner

DRUM FOR STRIKING UPWARDLY AND METHOD THEREFOR

BACKGROUND OF THE INVENTION

The present invention relates to drums, and particularly to a drum configured for striking the drum using an upward motion where the upward motion is generated from a movement of an arm or a wrist from an initial position to a striking position.

DESCRIPTION OF THE RELATED ART

Drums, in various forms and related percussion instruments, have been used for thousands of years among numerous civilizations for different purposes. Such purposes include to provide music, to thwart what was believed to be danger or the evil eye, to warn against imminent danger, and in religious rituals and dances. Drums are generally comprised of a frame defining a hollow body with a membrane, generally an animal skin, stretched across the frame. The membrane may be struck with hands, sticks, mallets or brushes. The membrane reverberates in response to these strikes, thereby creating a sound.

Through the centuries numerous drums have been developed that produce different sounds depending on the shape of the body, the type of membrane used, how tightly it is stretched across the body, the material used to form the body and other variables that are well known in the art. Examples of different drums that have evolved throughout the centuries include kettle drums, steel drums, bongo drums, tom-toms, bass drums, tenor drums, and snare drums. In addition there have been different methods used for drumming including methods relating to kettle drums, the popular conventional drums and the method of taiko drumming.

BRIEF SUMMARY OF THE INVENTION

Although there exist a wide variety of drums, the aforementioned drums are designed to be stricken downwardly. That is, the drum the is struck downwardly using an arm or wrist from an initial position to a striking position The drum is struck on the descent from a relatively higher position. It would be advantageous to have a further improvement in drum technology and drum playing where a drummer would be able to utilize a drum configured to be struck upwardly. That is, the drum is struck upwardly rather than downwardly using an upward motion of an arm or wrist.

In this regard drummers would be able to employ broader ranges of sounds and rhythms because a second array of drum beats would be available to the drummer that otherwise would not be available. The second array of drum beats occurs from striking a drum upwardly. By doing so, a method of doubling of drum beats can result from a complete upward and downward striking motion against a conventional drum and a drum of the present invention.

The drum of the present inventions also allows the musicians to use fewer arm and wrist motions to achieve a similar number of drum sounds so as to conserve energy.

BRIEF DESCRIPTION OF THE DRAWINGS

For a better understanding of the present invention, reference is made to the following description and accompanying figures, while the scope of the invention is set forth in the appended claims.

DETAILED DESCRIPTION OF THE INVENTION

In a preferred embodiment of the present invention, the upward drum is used in conjunction with a conventional drum so as to allow a drummer to successively strike each of the drums upwardly and downwardly respectively.

Figure 1:
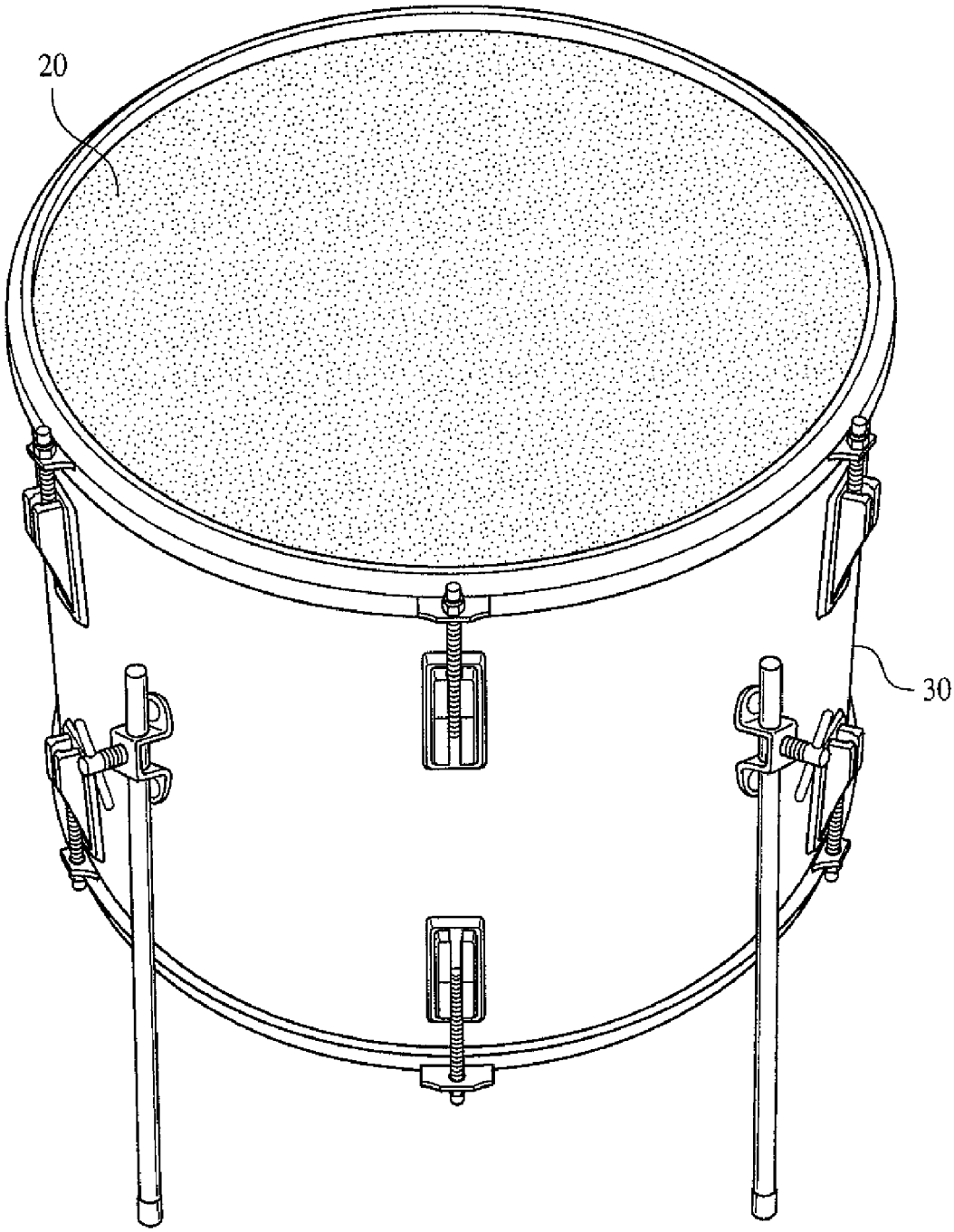
FIG. 1 (PRIOR ART)
FIG. 1 is a conventional drum of the prior art for striking on the downbeat.
Figure 2:
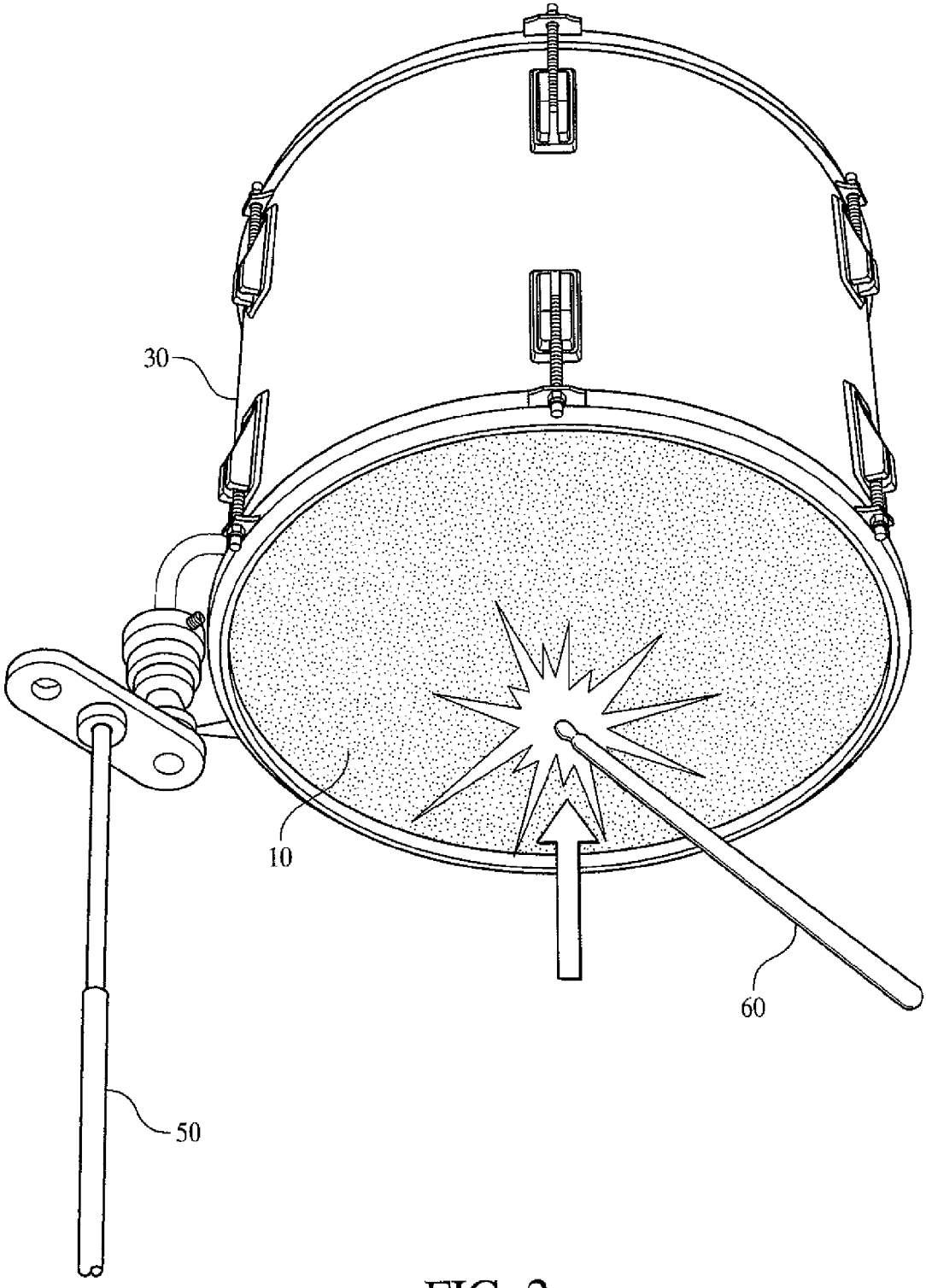
FIG. 2 is a exploded view of the drum of the present invention.

FIG. 1 shows a conventional drum, while FIG. 2 shows the upward drum of the present invention. The upbeat drum has a drum head with a first face 10 and a second oppositely disposed drum head with a face 20 and a substantially circular body therebetween 30. The upward drum is configured to be secured to a stand 50 in a preferred position so as to allow for striking the drum wherein the striking is derived from an upward motion from a wrist or an arm.

Figure 3:
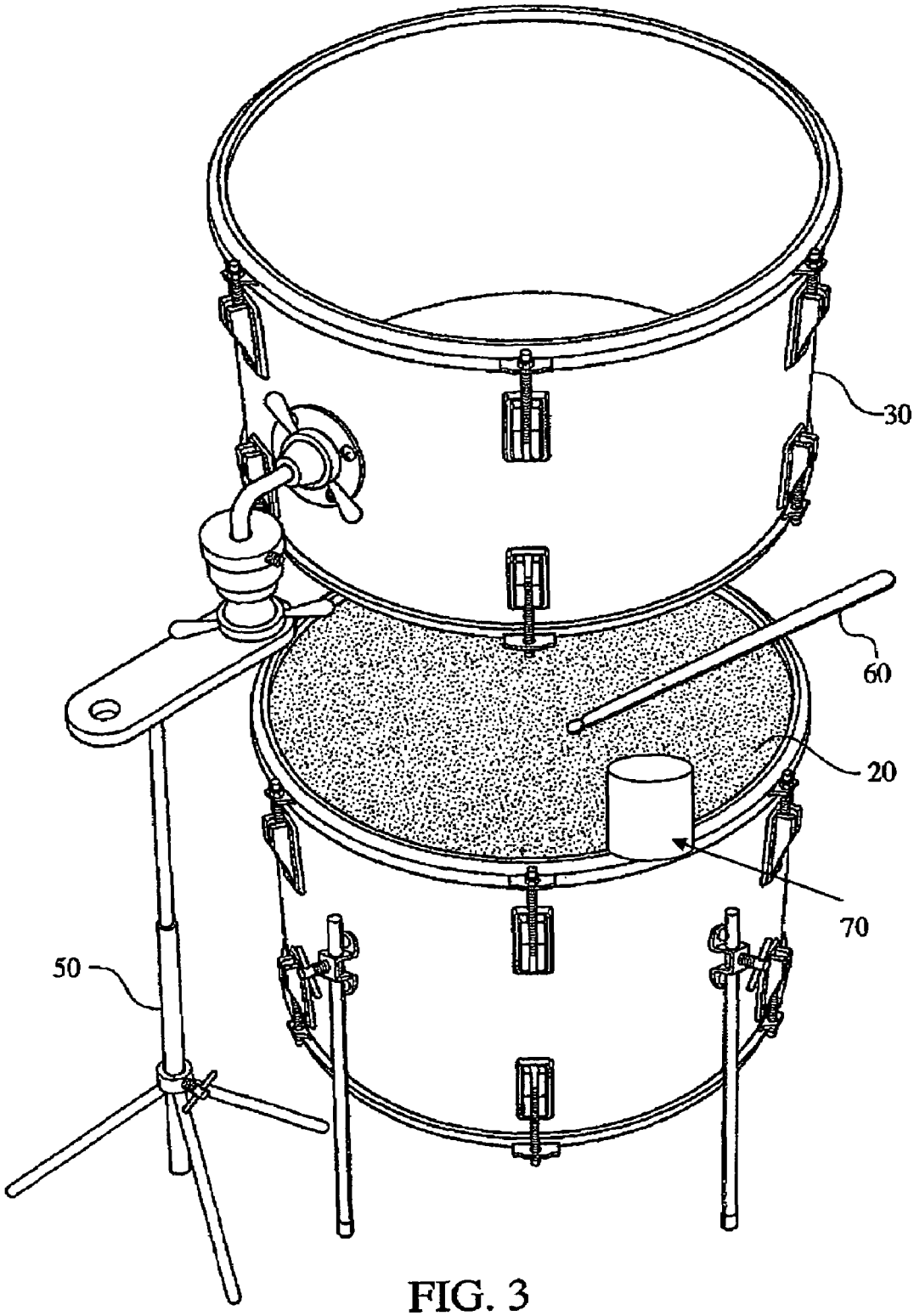
FIG. 3 shows the drum of the present invention in proximity with a conventional drum and telescopic stand.

FIG. 3 shows the upward drum proximate to a conventional drum, which has its own respective heads. A beater 60 (exemplified by a drum stick, a mallet, a brush or a hand) is used to generate sounds by striking a respective one of the drum heads of each of the upward drum and the conventional drum that face each other. Thus, the beater 60 is positioned between such respective heads of the upward drum and the conventional drum that face each other. By moving the beater 60 during a playing stroke toward one of the respective heads, an acoustic drum sound is generated upon impact. During the rebound stroke of the beater 60 during which the beater 60 moves in an opposite direction than it did during the playing stroke, the other of the heads is struck to generate an acoustic drum sound because the beater 60 was moved in a direction away from the one of the respective drum heads toward the other of the respective drum heads to strike same.

The upward drum is further equipped with hardware such that the drum can be tightened to a stand 50, at various angles so that it remains in position during playing. A tightening assembly may be affixed to the drum or the stand. If the tightening mechanism is affixed to the drum, then the stand would generally provide a place to receive the tightening assembly of the drum such that the drums would not fall to the ground. Assembly of the drum would be used to secure the mechanism on the drum to the stand in a fixed position. If the tightening assembly mechanism is located on the stand, then the drum would be equipped with a feature that allows it to be configured with the stand for securing the upward drum to the stand. In either case it may be permanently or temporarily connected to the drum or stand.

The stand 50 may be further equipped with a telescopic feature so that the upward drum can be secured at various heights depending upon the arrangement of the remaining drums and other related equipment and on the personal preferences of the drummer.

For added effect, accessory percussion instruments 70 may be provided between the drumheads, such as a cowbell, cymbal, hi-hat, tambourine, wood block or the like. They may be provided to stand alone on a separate stand or attached to the stand 50 used to elevate one of the drums. As is known conventionally, they may be attached to the rim of one of the drums.

Figure 4:
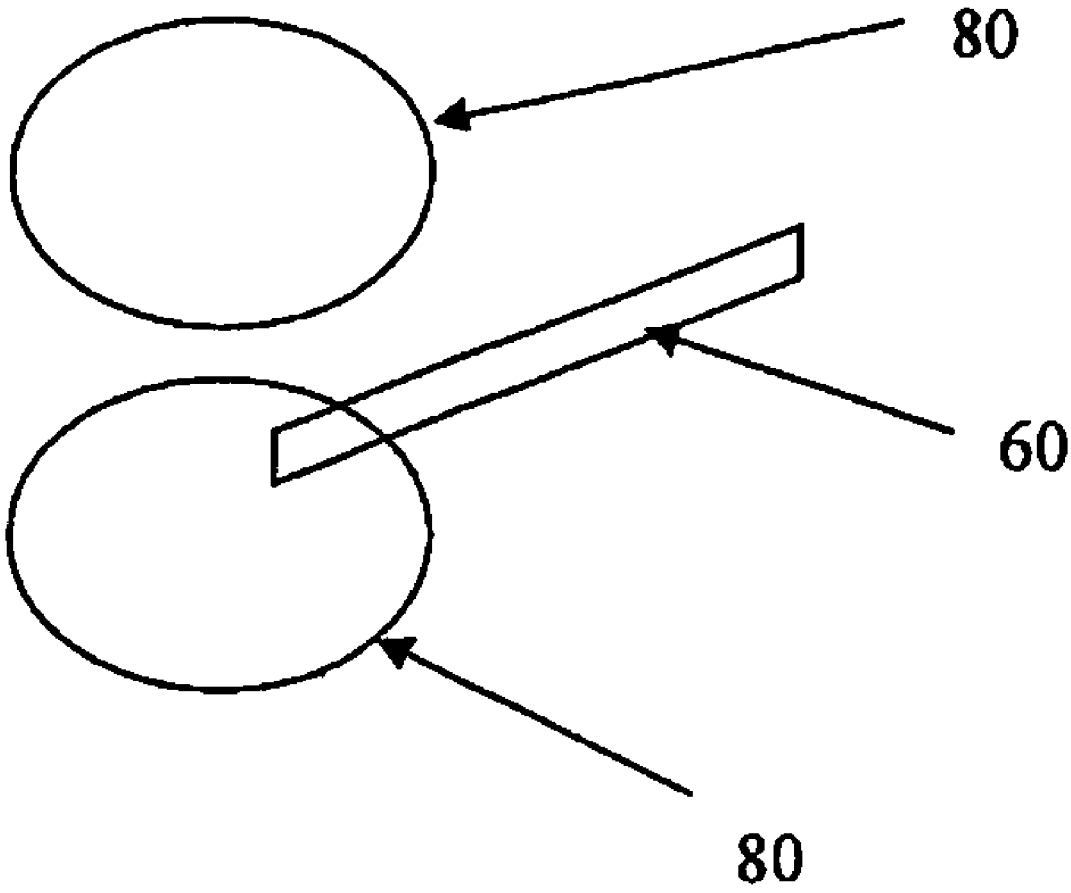
FIG. 4 shows a beater between two conventional electronic drum pads.

The term "drum" as used in this patent application is any type of percussion musical instrument having at least one stretched membrane to generate sound by acoustic vibration when the stretched membrane is struck. FIG. 3 shows the beater 60 between two such drums. The term "electronic drum pad" as used in this patent application is any type of electronic percussion musical instrument having an electronic waveform generator or sampler to generate the sound when the electronic drum pad is struck. The term "percussion instrument" shall be construed as a collective phrase encompassing both a drum and an electronic drum pad. FIG. 4 shows the beater 60 between two such electronic drum pads 80 that generate electronic waveforms.

Conventionally, electronic drum pads generate sound by an electronic waveform generator or sampler based on a voltage change being triggered in an embedded piezoelectric transducer (piezo) or force sensitive resistor (FSR) in response to the electronic drum pad being struck. The resultant signals are transmitted to an electronic drum module via TS or TRS cables and translated into digital waveforms, which produce the desired percussion sound assigned to that particular trigger pad.

Conventionally, a drum that generates sounds by acoustic vibration is a musical instrument in the percussion family, technically classified as a membranophone. Such drums consist of at least one membrane, called a "drumhead" or "drum skin", that is stretched over a shell and struck, either directly with parts of a player's body, or with some sort of beater implement such as a drumstick, mallet or brushes to produce sound. The shell almost invariably has a circular opening over which the drumhead is stretched, but the shape of the remainder of the shell varies widely. In the western musical tradition, the most usual shape is a cylinder, although timpani for example, use bowl-shaped shells. Other shapes include a frame design (tar), truncated cones (bongo drums) and joined truncated cones (talking drum).

Drums with cylindrical shells can be open at one end (as is the case with timbales or can have two drumheads. Single-headed drums normally consist of a skin or other membrane, called a head, which is stretched over an enclosed space, or over one of the ends of a hollow vessel. Drums with two heads covering both ends of a cylindrical shell often have a small hole somewhat halfway between the two drumheads; the shell forms a resonating chamber for the resulting sound. Exceptions include the African slit drum, made from a hollowed-out tree trunk, and the Caribbean steel drum, made from a metal barrel. Drums with two heads can also have a set of wires, called snares, held across the bottom head, top head, or both heads, hence the name snare drum.

On modern band and orchestral drums, the drumhead is affixed to a hoop (also called a "rim"), which in turn is held onto the shell by a "counterhoop", which is then held by means of a number of tuning screws called "tension rods" (also known as lugs) placed regularly around the circumference. The loosening or tightening of the rods enables adjustment of the head's tension. Many such drums have six to ten tension rods.

Drums are usually played by the hands, or by one or two sticks. The sound of a drum depends on several variables, including shape, size and thickness of its shell, materials from which the shell was made, type of drumhead used and tension applied to it, position of the drum, location, and a manner in which it is struck.

Within the realm of popular music and jazz, "drums" usually refers to a drum kit or a set of drums, and "drummer" to the actual band member or person who plays them. Drums are played by percussionists whose skills can be called for in all areas of music, from Classical to Heavy Rock, and all points in between. Many drummers are also adept at playing both the drum set and a set of hand drums for added musical variety.

The present invention applies to any kind of drum that is a percussion musical instrument, inclusive of snare, bass, tenor, timbales, timpani, bongo, slit, steel, talking, Tailko and any combination of the same or different kinds.

Snare Drum:

A small double-headed drum having one or more wires or cords stretched across the bottom head to increase reverberation.

A small drum having a drumhead at either end. One head is struck with wooden drumsticks, and on the other are stretched several strings, called snares, which cause a rattling against the head.

A shallow cylindrical drum, with wires or pieces of catgut (snares) stretched across the bottom skin to give a sharp, rattling sound when the top skin is struck.

A tubular drum made of wood or metal with skins, or heads, stretched over the top and bottom openings, and with a cluster or set of snares (cords) stretched across the bottom head (internally or externally). When the top head is struck, causing a sudden increase in pressure within the instrument, the snares vibrate against the bottom head. This produces a short, distinctive, snap-like sound. The snares can be disengaged if this effect is not wanted. Snare drums come in many different sizes as well, which ultimately changes the way the drum will sound. Snare drums that are shallow in size will give a higher "crack" sound, while the deeper ones will give a heavier and thicker tone. The same is true of drums with a smaller diameter.

The drum can be sounded by hitting it with a drum stick or any other form of beater, including brushes, which produce a softer-sounding vibration from the wires. When using a stick, the drummer may strike either the head of the drum, the rim, or the shell. When the drummer strikes both the rim and the head, this is known as a rimshot. Because of the dramatic, sudden vibration on the shell of the drum, the rimshot is generally louder and more distinct than other snare drum sounds.

Snare Drum Types:

Jazz: In jazz brushes are often used, so generally the drum will be fitted with a thin to medium-weight coated (textured) head, with little or no muffling. Most shell dimensions and materials are suitable for jazz, with 14"×5.5" or 14"×6" wood or brass being the most common.

Rock: Commonly 14" in diameter and 5.5" to 8" deep, often stainless steel. Often the drum will have some muffling, and heavier non-coated heads used.

Metal: This genre favors wider and deeper drums, maybe a 14"×6" or even as deep. Metal drummers often use materials other than wood for higher volume and brighter timbre. Metal, in particular brass, bronze, and aluminum, are popular. Some snares are made of unusual materials like acrylic plastic of carbon fiber.

Punk: In much early punk music the snare does not have a big voice; often it's mixed to be only as loud as the hi-hats. This may be due to punk's non-conventional standard of quality for the drummers' performance, recording quality and drum tuning. Commonly the dimensions are the same to those of rock: 14"×5.5-6". Heads and tuning may vary wildly according to the drummer.

Funk: Funk snare drum work is very accented and syncopated, so in order for this to stand out, a higher snare sound is required. 13" diameters are common in funk, though 14" is equally popular. The depth of snare drums used in funk can vary greatly.

Bass Drum:

A large drum having a cylindrical body and two heads and producing a low, resonant sound.

A large drum with two heads; makes a sound of indefinite but very low pitch.

A bass drum is a large drum that produces a note of low definite or indefinite pitch. There are three general classifications of bass drums: the concert bass drum, the 'kick' drum, and the pitched bass drum. The type usually seen or heard in orchestral or concert band music is the concert bass drum. The 'kick' drum, struck with a beater attached to a foot pedal, is usually seen on drum kits. The third type, the pitched bass drum, is generally used in marching bands and drum corps. This particular type of drum is tuned to a specific pitch and is usually played in a set of three to six drums.

Bass Drum Types:

In popular music, the bass drum is used to mark time. In marches it is used to project tempo (marching bands historically march to the beat of the bass). A basic beat for rock and roll has the bass drum played on the first and third beats of a bar of common time, with the snare drum on the second and fourth beats, called "back beats". In jazz, the bass drum can vary from almost entirely being a timekeeping medium to being a melodic voice in conjunction with the other parts of the set. In classical music, the bass drum often punctuates a musical impact, although it has other valid uses.

An orchestral, or concert bass drum is quite large, about 36" in diameter, and is played with one or sometimes two large, padded mallets. Usually the right hand plays the drum and the left hand muffles it. When played with both mallets, a knee or forearm can be used for damping.

Many different timbres, or sound-colors result depending on how and where the drum is struck. Implements used to strike the drum may include bass drum beaters of various sizes, shapes, and densities, as well as keyboard percussion mallets, timpani mallets, and drumsticks. Concert bass drums can sometimes be used for sound effects. e.g. thunder, or an earthquake.

In a drum kit, the bass drum is much smaller, most commonly 20" or 22" but sizes from 16" to 24" are quite normal, with depths of 14" to 18", although some brands have made 20" sizes. 26" in diameter is not unusual in a big band, and extremes both larger and smaller are sometimes seen. It is usually more heavily muffled than the classical drum, although it can be a bit "boomy". This is stopped a pillow or a blanket placed against the back head to produce a good solid thud. It is played using a pedal operated mallet, which a right-handed drummer will conventionally operate with the right foot. Sometimes the front head of a bass drum has a hole in it to allow air to escape when the drum is struck for shorter sustain. Muffling, such as pillows and blankets, can be installed through the hole without taking off the front head. The hole also allows microphones to be placed into the bass drum for recording and amplification. In addition to microphones, sometimes trigger pads are used to amplify the sound and provide a uniform tone, especially when fast playing is too difficult.

One of the many ways to use the foot to hit the pedal is the "heel-toe" motion, where the drummer first puts down the heel and rolls onto the ball of the foot. This method uses a rocking motion and makes it easier for the drummer to hit the pedal quicker.

Tenor drum: A low-pitched cylindrical drum, but slightly higher pitched than a bass drum. Any of various drums with small heads. Synonym: tomtom Multi Tenor drums: Tenor drums (commonly as mounted sets of 3-6 drums) are a marching percussion instrument, allowing one person to carry and play multiple drums simultaneously. Other names for the drums include the general "toms" and "timp toms", as well as the number-specific "tris", "trios" or "tri toms" (3 drums), "quads" or "quad toms" (4 drums), "quints" (5 drums), and "squints," "hexes," "six-packs," or "sextets" (6 drums). Interestingly, the number-specific term "quads" has come to be accepted as a generic term, used by many lines that utilize 4-6 drum sets. Typically there are four main drums (usually either 8, 10, 12, and 13 or 10, 12, 13, and 14 inches in diameter) and one or two accent drums (typically 6 or 8 inches in diameter). The accent drums are also known as shot, gock, or spock drums. Sometimes there are other percussion instruments added such as cow bells or cymbals.

For four drums, they are arranged so that the lowest drum is to the player's far left, the second lowest is on the player's far right, the second highest is on the middle left, and the highest is on the middle right. This makes it easier to play common patterns, and is easier to balance than they would be if they were in order in a line. If there is a fifth drum it is placed between the player and the highest two drums. If there are six drums, the sixth is placed just to the right of the fifth.

Most of the time, tenor drums are tuned relatively tightly, giving them a high-pitched sound that carries well outdoors. Within the set of drums, the main drums are tuned to relative intervals (more common intervals being the minor 3rd, perfect 4th, and perfect 5th), while the accent drums are generally tuned as high as possible without breaking the head (often humorously referred to as "higher" and "highest", in the case of a 6-drum set).

Tenors are played with mallets or drumsticks. A wide variety of implements are available, encompassing a full spectrum of shaft materials (hickory and aluminum are the most popular), head materials (wood, plastic/nylon, rubber, felt, and fleece "puffs" are all common), and head shape/size (ranging from large "cartwheel" discs to traditional drum stick beads)

Most tenor players use matched grip. This facilitates tenor techniques such as "sweeps" or "scrapes" (playing multiple strokes on one hand in succession, while moving across different drums) and "crossovers" (crossing one hand over the other to reach a drum). These techniques allow an incredible variety of rhythmic and melodic figures possible on the tenors, as well as adding a distinct visual element to tenor playing.

Taiko drums: Taiko, in general, are stick percussion instruments. With the exception of the kotsuzumi and ootsuzumi, all taiko are struck with drumsticks. They have heads on both sides of drum body, and a sealed resonating cavity. Taiko are also characterized by a high amount of tension on the drums heads, with a correspondingly high pitch relative to body size. This high tension likely developed in response to Japan's wet and humid summers when most festivals take place. Many taiko are not tunable, and a drum with high head tension would counteract the slacking effects of humidity. Taiko are categorized into two types of construction. Byou-uchi daiko taiko have heads nailed to the body. Tsukushime-daiko have heads sewn onto iron rings, which are then laced to each other around the drum body.

Byou-uchi daiko are typically hollowed out of a single piece of wood. The preferred wood is keyaki due to its density and beautiful grain, but a number of other woods are used, grouped under the generic term meant Byou-uchi daiko cannot be tuned, and their sizes are limited by the diameter of the tree they are made from.

The typical byou-uchi daiko is the nagado-daiko (long-body taiko). It is roughly shaped like a wine barrel, and is available in a variety of sizes, from 1.0 shaku (12" in head diameter), to 3.0 shaku in 1 sun increments. Nagado-daiko over 3.0 shaku are also available, but they are referred to as odaiko (big, fat drum). Smaller byou-uchi daiko such as the sumo-daiko and hayashi-daiko also exist.

Tsukeshime-daiko are available in a wide variety of styles, and are tunable. This style of taiko is typically tensioned before each performance. The tensioning system is usually rope, but bolt systems and turnbuckles have been used as well. Tsukeshime-daiko can either have stitched heads placed on bodies carved from single piece of wood, such as the shime-daiko and tsuzumi, or stitched heads placed on a stave-construction body such as the okedo-daiko.

The shime-daiko is roughly snare-drum sized, is available in five weights. The lightest is used in classical music such as noh and kabuki. The okedo-daiko (barrel-body taiko, often shortened to "okedo" or "oke") has a long, stave construction, cylindrical body. It is available in the same size ranges as the nagado-daiko, and a taiko of okedo style is currently Japan's largest taiko. Depending on size, they can be set on a stand and played like other taiko, but they also strapped to the body so the drummer can move and play at the same time.

Other Japanese taiko include the uchiwa-daiko (fan taiko), hira-daiko (flat taiko), o-daiko (big taiko), and a host of percussion instruments used in Japan's traditional noh, gagaku and kauki ensembles.

Drumming Hand Grips: In snare drumming, there is a matched grip and a traditional grip. The matched grip includes three kinds: French, German and American.

The matched grip is a method of holding drumsticks and mallets to play percussion instruments in which each hand holds its stick in the same way. Almost all commonly used matched grips are overhand grips.

The matched grip is performed by gripping the drumsticks with one's index finger and middle finger curling around the bottom of the stick and the thumb on the top. This allows the stick to move freely and bounce after striking a percussion instrument.

The French grip is a technique used to hold drumsticks and mallets to play percussion instruments. In this form of matched grip, the palms of the hands face directly toward each other and the stick is moved primarily with the fingers rather the wrist as in the German grip. This allows a greater degree of finesse, which is why many timpanists prefer French grip. For louder strokes, the wrist rotates much in the same way as when hammering a nail.

The German grip is a technique used to hold drumsticks and mallets to play percussion instruments. In this form of matched grip, the palms of the hands are parallel to the drumhead or other playing surface, and the stick is moved primarily with the wrist. German grip provides a large amount of power, but sacrifices the finesse provided by the use of the fingers as in the French grip. It is used when power is the primary concern, such as when playing a bass drum.

The American grip is a technique used to hold drumsticks and mallets to play percussion instruments. This form of matched grip is a hybrid of the French grip and the German grip. The palms of the hands typically are at about a 45-degree angle, and both the fingers and wrist are used to propel the stick. This grip combines the power of German grip with the finesse of French grip. It is used to play everything from snare drums to xylophones.

The Traditional grip is a technique used to hold drumsticks to play percussion instruments. Unlike the matched grip, each hand holds the stick differently. Commonly, the right hand uses an overhand grip and the left hand uses an underhand grip. Traditional grip is almost exclusively used to play the snare drum, especially the marching snare drum and the drum kit.

This grip is called traditional because it descends from the early days when the snare drum was carried over the shoulder on a sling. Since the drum is tilted, using an overhand grip on the high side of the drum forces the elbow in a very awkward position. In this case, an underhand grip is much more comfortable. Even when the drum is on a stand, many drummers will tilt their drum when using traditional grip, although tilting is not required. Many drummers use traditional grip on drums that are perfectly horizontal, especially in marching percussion.

The overhand grip most commonly used is the American grip. With the underhand grip, there are several different techniques employed which involve slight variations in finger positioning and usage. Common with all techniques is the usage of the wrist in rotating (a motion like turning a door knob) as the fundamental motion of the stick. The stick then rest in the space between the thumb and index finger, and the two fingers close around the stick with the thumb atop the index at the first knuckle. The middle finger then rests slightly on the topside of the stick (typically the side fingertip is the only contact made). The stick then rests on the cuticle of the ring finger with the pinky support the ring finger from below.

While the foregoing description and drawings represent the preferred embodiments of the present invention, it will be understood that various changes and modifications may be made without departing from the spirit and scope of the present invention. Such assemblies are well known in the art.

What is claimed is:

1. A percussion instrument, comprising;

a support structure for supporting two surfaces, the support structure supporting the two surfaces in a position in which they are spaced apart from each other and arranged to face each other, the surfaces being separated by the space such that one of the surfaces is entirely below the space between the surfaces and the other surface is entirely above the space between the surfaces and a height of each of the surfaces is a height suitable for play by hand; and a hand held beater having a distal end which can be positioned selectively between the two surfaces, the beater and the two surfaces being selected relative to each other such that each of the surfaces provides a rebound effect when struck by the beater, the support structure being arranged to enable one of the surfaces to move relative to the other surface to thereby cause the surfaces to be at a set distance from one another so that after the distal end of the beater positioned between the two surfaces strikes one of the surfaces during a downward or upward playing stroke, the beater then rebounds away during a rebound stroke in a direction toward the other of the surfaces and strikes the other surface upon continued movement during the rebound stroke, each of the surfaces being selected from a group consisting of a tensioned drumhead that generates acoustic sounds in response to being struck by the beater and an electronic drum pad that generates digital waveforms in response to being struck by the beater.

2. The percussion instrument of claim 1, wherein the beater is selected from a group consisting of a drumstick, a mallet and a brush, the beater being movable independent of the two surfaces into the space between the two surfaces and completely out of the space between the two surfaces.

3. The percussion instrument of claim 1, wherein the support structure comprises a telescopic assembly configured to position a first one of the two surfaces at a different elevation than that of a second one of the two surfaces, the telescopic assembly being coupled to the first surface and arranged to enable vertical movement of the first surface relative to the second surface to thereby change the space between the first and second surfaces.

4. The percussion instrument of claim 1, wherein at least one of the surfaces is a tensioned drumhead that is part of a drum, the other of the surfaces being the electronic drum pad.

5. The percussion instrument of claim 1, wherein each of the surfaces is part of respective electronic drum pads.

6. The percussion instrument of claim 1, wherein each of the surfaces is a tensioned drumhead that is part of a respective drum.

7. The percussion instrument of claim 6, wherein each of the respective drums is selected from a group consisting of snare drums, bass drums, tenor drums, slit drums, steel drums, timpani, timbales, talking drums, bongo drums and Taiko drums.

8. The percussion instrument of claim 7, wherein the drums are different kinds of drums.

9. The percussion instrument of claim 1, further comprising an accessory percussion instrument arranged between the surfaces, the accessory percussion instrument being selected from a group consisting of a cowbell, cymbal, hi-hat, tambourine and wood block.

10. The percussion instrument of claim 1, wherein the support structure comprises a stand configured to retain a first one of the two surfaces at an elevation higher than that of the second of the two surfaces, the stand being coupled to the first surface and arranged to enable vertical movement of the first surface relative to the second surface to thereby change the space between the first and second surfaces.

11. The percussion instrument of claim 1, wherein one of the two surfaces is obliquely angled relative to the other of the two surfaces.

12. A method of arranging and positioning a percussion instrument, comprising:

arranging two surfaces spaced apart from each other and to face each other, the surfaces being arranged to be separated by the space such that one of the surfaces is entirely below the space between the surfaces and the other surface is entirely above the space between the surfaces and a height of each of the surfaces is a height suitable for play by hand;

selectively positioning a hand held beater having a distal end between the two surfaces, selecting the beater and the two surfaces relative to each other such that each of the surfaces provides a rebound effect when struck by the hand held beater, and adjusting the position of one of the surfaces relative to the other surface to thereby cause the surfaces to be at a set distance from one another so that after the distal end of the beater strikes one of the surfaces during a downward or upward playing stoke, the beater then rebounds away during a rebound stroke in a direction toward the other of the surfaces and strikes the other surface upon continued movement during the rebound stroke.

13. The method of claim 12, further comprising selecting the beater from a group consisting of a drumstick, a mallet and a brush.

14. The method of claim 12, further comprising:

coupling a telescopic assembly to a first one of the surfaces to enable vertical movement of the first surface relative to a second one of the surfaces; and adjusting the telescopic assembly to position the first surface at a different elevation than that of the second surfaces and thereby change the space between the first and second surfaces.

15. The method of claim 12, wherein at least one of the surfaces is a tensioned drumhead that is part of a drum, the other of the surfaces being the electronic drum pad.

16. The method of claim 12, wherein each of the surfaces is part of a respective electronic drum pad.

17. The method of claim 12, wherein each of the surfaces is a tensioned drumhead that is part of a respective drum.

18. The method of claim 17, further comprising selecting each of the respective drums from a group consisting of snare drums, bass drums, tenor drums, slit drums, steel drums, timpani, timbales, talking drums, bongo drums and Taiko drums.

19. The method of claim 18, further comprising selecting the respective drums to be of different kinds of drums.

20. The method of claim 12, further comprising arranging an accessory percussion instrument between the surfaces, the accessory percussion instrument being selected from a group consisting of a cowbell, cymbal, hi-hat, tambourine and wood block.

21. The method of claim 12, further comprising retaining one of the two surfaces at an elevation higher than that of the other of the two surfaces.

22. The method of claim 12, further comprising angling one of the two surfaces obliquely relative to the other of the two surfaces.

23. A percussion instrument, comprising:

a support structure for supporting two surfaces in the form of a percussion surface, the support structure supporting the two surfaces in a position in which they are spaced apart from each other and arranged to face each other, the surfaces being separated by the space such that one of the surfaces is entirely below the space between the surfaces and the other surface is entirely above the space between the surfaces and a height of each of the surfaces is a height suitable for play by hand, and a hand held beater having a distal end which can be selectively positioned between the two surfaces, the beater and the two surfaces being selected relative to each other such that each of the surfaces provides a rebound effect when struck by the beater, and the support structure comprising a height adjustment mechanism configured and arranged to independently adjust relative heights of the surfaces with respect to each other and such that one of the surfaces is at a elevation that is higher than that of the other of the surfaces, the height adjustment mechanism being arranged to cause the surfaces to be at a set distance from one another, after adjustment of the relative heights, so that after the distal end of the beater positioned between the two surfaces strikes one of the surfaces during a downward or upward playing stroke, the beater then rebounds away during a rebound stroke in a direction toward the other of the surfaces and strikes the other surface upon continued movement during the rebound stroke, each of the surfaces being selected from a group consisting of a tensioned drumhead that generates acoustic sounds in response to being struck by the beater and an electronic drum pad that generates digital waveforms in response to being struck by the beater.

24. The percussion instrument of claim 23, wherein the height adjustment mechanism includes a stand having tripod legs, the support structure which supports one of the surfaces being connected to the stand, the support structure for the other one of the surfaces being independent of the stand.

* * * * *